US009357805B2

(12) United States Patent
Wright

(10) Patent No.: US 9,357,805 B2
(45) Date of Patent: Jun. 7, 2016

(54) COUGH AND SNEEZE ARRESTOR

(71) Applicant: Victor S. Wright, Lakewood, CA (US)

(72) Inventor: Victor S. Wright, Lakewood, CA (US)

( * ) Notice: Subject to any disclaimer, the term of this patent is extended or adjusted under 35 U.S.C. 154(b) by 48 days.

(21) Appl. No.: 13/928,151

(22) Filed: Jun. 26, 2013

(65) Prior Publication Data

US 2014/0014120 A1 Jan. 16, 2014

Related U.S. Application Data

(63) Continuation of application No. 12/576,196, filed on Oct. 8, 2009, now abandoned.

(51) Int. Cl.

| | |
|---|---|
| ***A61J 19/00*** | (2006.01) |
| ***A41D 13/11*** | (2006.01) |
| *A61J 19/06* | (2006.01) |

(52) U.S. Cl.

CPC ..... *A41D 13/1192* (2013.01); *A61J 19/00* (2013.01); *A61J 19/06* (2013.01)

(58) Field of Classification Search

CPC ..... A61J 19/06; A61J 19/02
USPC ..... 4/258–285; 128/206.19, 275, 200.24; 55/DIG. 33

See application file for complete search history.

(56) References Cited

U.S. PATENT DOCUMENTS

| | | | | |
|---|---|---|---|---|
| 2,681,060 | A * | 6/1954 | Swindell | 128/206.12 |
| 4,768,238 | A * | 9/1988 | Kleinberg et al. | 4/258 |
| 4,771,486 | A | 9/1988 | Gutierrez et al. | |
| 2005/0123589 | A1 * | 6/2005 | Gabbay | 424/443 |
| 2009/0057220 | A1 * | 3/2009 | Nauta | 210/282 |
| 2009/0241524 | A1 * | 10/2009 | Takeshima et al. | 60/299 |
| 2010/0018533 | A1 * | 1/2010 | Biedermann et al. | 128/206.19 |

* cited by examiner

*Primary Examiner* — Huyen Le
*Assistant Examiner* — Christine Skubinna
(74) *Attorney, Agent, or Firm* — Loza & Loza, LLP; Heidi Eisenhut

(57) ABSTRACT

Embodiments of the invention are directed to hygienic devices to control the spread of airborne viruses and bacteria emanating from coughing or sneezing. In one embodiment, the hygienic device is a cough and sneeze arrestor in the form of a "coughing cup." The coughing cup may incorporate one or more filters with a plurality of apertures of varying sizes and/or no apertures. In some embodiments, the filters may be embedded or infused with a microbicide such as an antibacterial or viricide. The filters may be pre-attached within the coughing cup at certain predetermined locations. The coughing cup may have one or more recesses to accommodate the nose and/or a chin of a person when using the coughing cup.

19 Claims, 5 Drawing Sheets

COUGH AND SNEEZE ARRESTOR

REFERENCE TO RELATED APPLICATIONS

This application is a continuation of U.S. patent application Ser. No. 12/576,196, filed Oct. 8, 2009, entitled "COUGH AND SNEEZE ARRESTOR", the entire content of which is incorporated herein by reference.

FIELD OF INVENTION

Hygienic devices.

BACKGROUND OF INVENTION

Airborne viruses and bacteria can be easily spread through direct contact with contaminated items, e.g., door handles, table tops, or railings, or by coughing and sneezing. Infected persons who may spread airborne viruses and bacteria are often in public places by necessity or on purpose because, for example, they may not even be aware that they are contagious. In any case, the spread of airborne viruses and bacteria can be rapid and swift.

One method that infected persons use to control the spread of airborne viruses and bacteria in public is to cover his/her mouth with a hand or arm when coughing or sneezing. While this method may limit the spread of particulates emanating from the cough or sneeze, it does not completely contain the cough or sneeze. Moreover, the particulates will thereafter be on the person's hands and can be deposited on door handles, rails or any other public item. The particulates can be transferred to an unknowing person and cause subsequent infection.

Another method that infected persons use to control the spread of airborne viruses and bacteria in public is to use a tissue when coughing or sneezing. This method also limits the spread of particulates emanating from the cough or sneeze, however, similar to the above, it does not completely contain the cough or sneeze. A tissue is porous and can let airborne viruses, bacteria and particulates pass through. Moreover, the person using the tissue uses his or her hand to handle the tissue therefore transferring viruses, bacteria and particulates to the person's hand which may be subsequently deposited on door handles, rails or any other public item. Similar to the above, the particulates can be transferred to an unknowing person and cause subsequent infection.

With the break-out of new and virulent viruses, such as the H1N1 flu virus, or the so-called "swine flu" virus, the need for controlling the spread of airborne viruses and bacteria in public in eminent. Consequently, a method or device which alleviates the problems associated with the methods and devices discussed above is needed.

SUMMARY OF INVENTION

A hygienic device to control the spread of airborne viruses and bacteria emanating from coughing or sneezing, comprising: (i) a cup having a rim; (ii) a first filter suspended and attached within an interior of the cup near an opening of the cup, the first filter having a plurality of apertures of a first size; (iii) a second filter suspended and attached within the interior of the cup near a middle of the cup, the second filter having a plurality of apertures of a second size; and (iv) a third filter suspended and attached within the interior of the cup near a bottom of the cup is herein disclosed.

The hygienic device may further comprise: (v) a first recess in the rim of the cup, the first recess to accommodate a nose of a person; and (vi) a second recess in the rim of the cup, the second recess positioned 180 degrees relative to the first recess, the second recess to accommodate a chin of the person. The diameter of each of the plurality of apertures of the first size may be greater than a diameter of each of the plurality of apertures of the second size. The plurality of apertures of the first size may be symmetrically spaced throughout the first filter and each of the plurality of apertures of the second size may be symmetrically spaced throughout the second filter. The plurality of apertures of the first size may be between 500 micrometers and 1500 micrometers and the plurality of apertures of the second size may be between 250 micrometers and 750 micrometers. Each of the first, second and third filters may be embedded with a microbicide. The microbicide may be an antibacterial, viricide or a combination thereof. The microbicide may be an antibacterial selected from the group consisting of benzalkonium chloride (BAC), cetyl trimethylammonium bromide (CTMB), cetylpyridinium chloride (CPC), benzethonium chloride (BZT) or any combination thereof. The cup may be comprised of a material, the material one of paper, polylactic acid or polystyrene foam. Each of the first, second and third filters may be comprised of an absorbent material.

A hygienic device to control the spread of airborne viruses and bacteria emanating from coughing or sneezing, comprising: (i) a containment device, the containment device approximately cylindrical, the containment device closed on a first end and open on a second end, the containment device having a sidewall extending from the first end to the second end; (ii) a first filter suspended and attached within an interior of the sidewall of the device near the open second end, the first filter having a plurality of apertures of a first size; (iii) a second filter suspended and attached within the interior of the sidewall of the device near a middle of the device, the second filter having a plurality of apertures of a second size; and (iv) a third filter suspended and attached within the interior of the sidewall of the device near the closed first end is herein disclosed.

The hygienic device may further comprise (v) a first recess in the rim of the device, the first recess to accommodate a nose of a person; and (vi) a second recess in the rim of the device, the second recess positioned 180 degrees relative to the first recess, the second recess to accommodate a chin of the person. The diameter of each of the plurality of apertures of the first size may be greater than a diameter of each of the plurality of apertures of the second size. Each of the plurality of apertures of the first size may be symmetrically spaced throughout the first filter and each of the plurality of apertures of the second size may be symmetrically spaced throughout the second filter. The plurality of apertures of the first size may be between 500 micrometers and 1500 micrometers and the plurality of apertures of the second size may be between 250 micrometers and 1500 micrometers. Each of the first, second and third filters may be embedded with a microbicide. The microbicide may be an antibacterial, viricide or a combination thereof. The microbicide may be an antibacterial selected from the group consisting of benzalkonium chloride (BAC), cetyl trimethylammonium bromide (CTMB), cetylpyridinium chloride (CPC), benzethonium chloride (BZT) or any combination thereof. The device may be comprised of a material, the material one of paper, polylactic acid or polystyrene foam. Each of the first, second and third filters may be comprised of an absorbent material.

DETAILED DESCRIPTION

The following detailed description is of the best currently contemplated modes of carrying out the invention. The description is not to be taken in a limiting sense, but is made merely for the purpose of illustrating the general principles of the invention.

Embodiments of the invention are directed to hygienic devices to control the spread of airborne viruses and bacteria emanating from coughing or sneezing. In one embodiment, the hygienic device is a cough and sneeze arrestor in the form of a "coughing cup." The coughing cup may incorporate one or more filters with a plurality of apertures of varying sizes and/or no apertures. In some embodiments, the filters may be embedded or infused with a microbicide such as an antibacterial or viricide. The filters may be pre-attached within the coughing cup at certain predetermined locations. The coughing cup may have one or more recesses to accommodate the nose and/or a chin of a person when using the coughing cup.

Figure 1A:
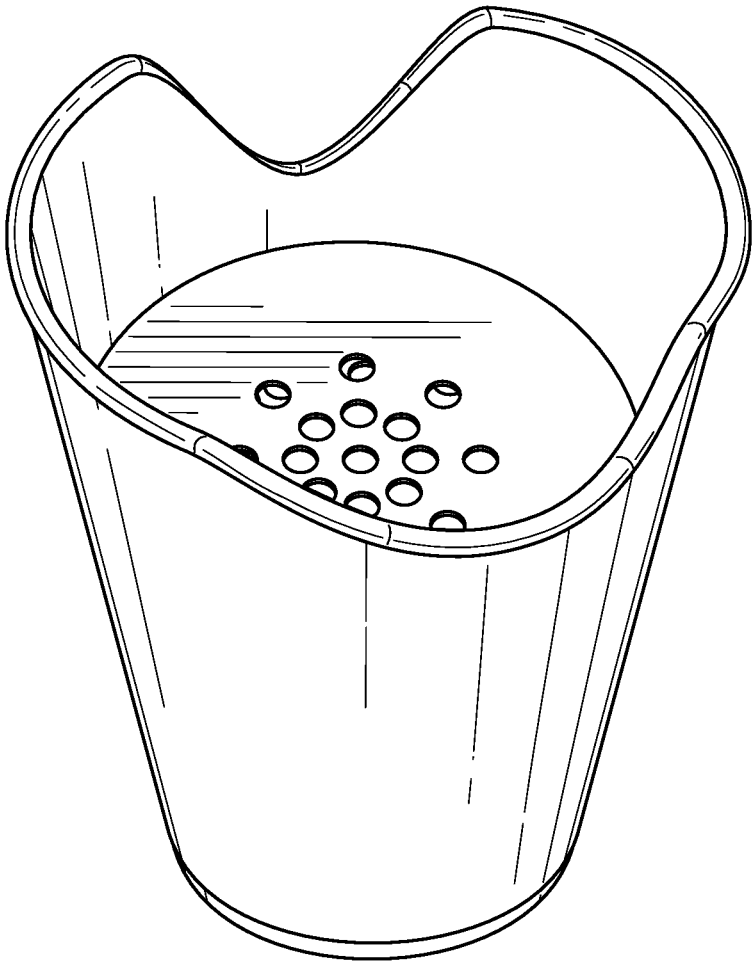
FIG. 1A illustrates a perspective view of a hygienic device to control the spread of airborne viruses and bacteria emanating from coughing or sneezing according to an embodiment of the invention.
Figure 1B:
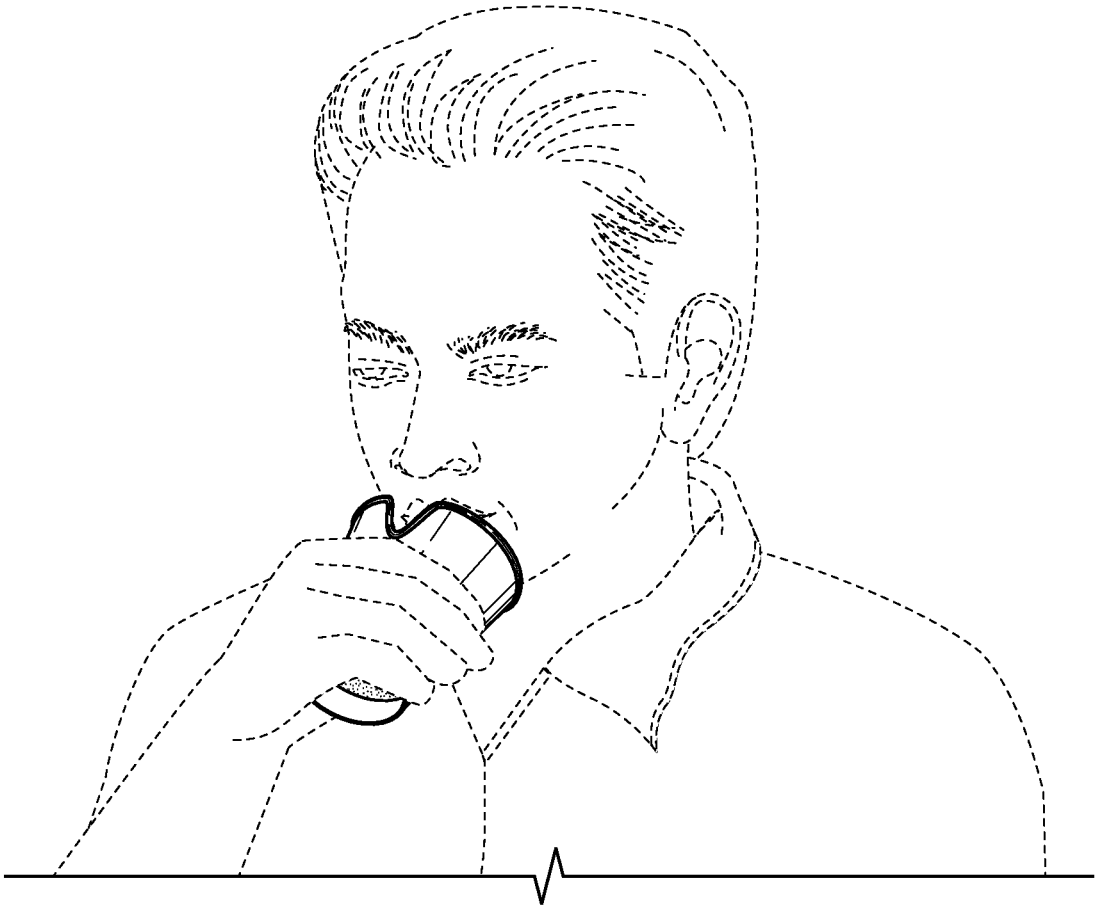
FIG. 1B illustrates the device of FIG. 1A being used by a person.

FIG. 1A illustrates a perspective view of a hygienic device to control the spread of airborne viruses and bacteria emanating from coughing or sneezing according to an embodiment of the invention. According to this embodiment, the hygienic device 100 is a containment device in the form of a modified disposable cup. That is, the device 100 may have an opening 102 defined by a rim 104, i.e., first end, a closed circular "bottom" 106, i.e., second end, and a cylindrical sidewall extending from the rim 104 to the bottom 106. In some embodiments, a diameter of the opening 102 is greater than a diameter of the bottom 106. In other embodiments, the diameter of the opening 102 is the same as the diameter of the bottom 106. Materials which comprise the device 100 include, but are not limited to, paper, polylactic acid, polystyrene foam or any other suitable material. The rim 104 may have a first recess 108, i.e., "nose bridge," for accommodating the nose when used by a person and optionally a second recess 110, i.e., "chin bridge," for accommodating the chin when used by a person. In some embodiments, the rim 104 is reinforced to assist in forming a substantial or complete seal when in use. FIG. 1B illustrates the device of FIG. 1A being used by a person.

Figure 2:
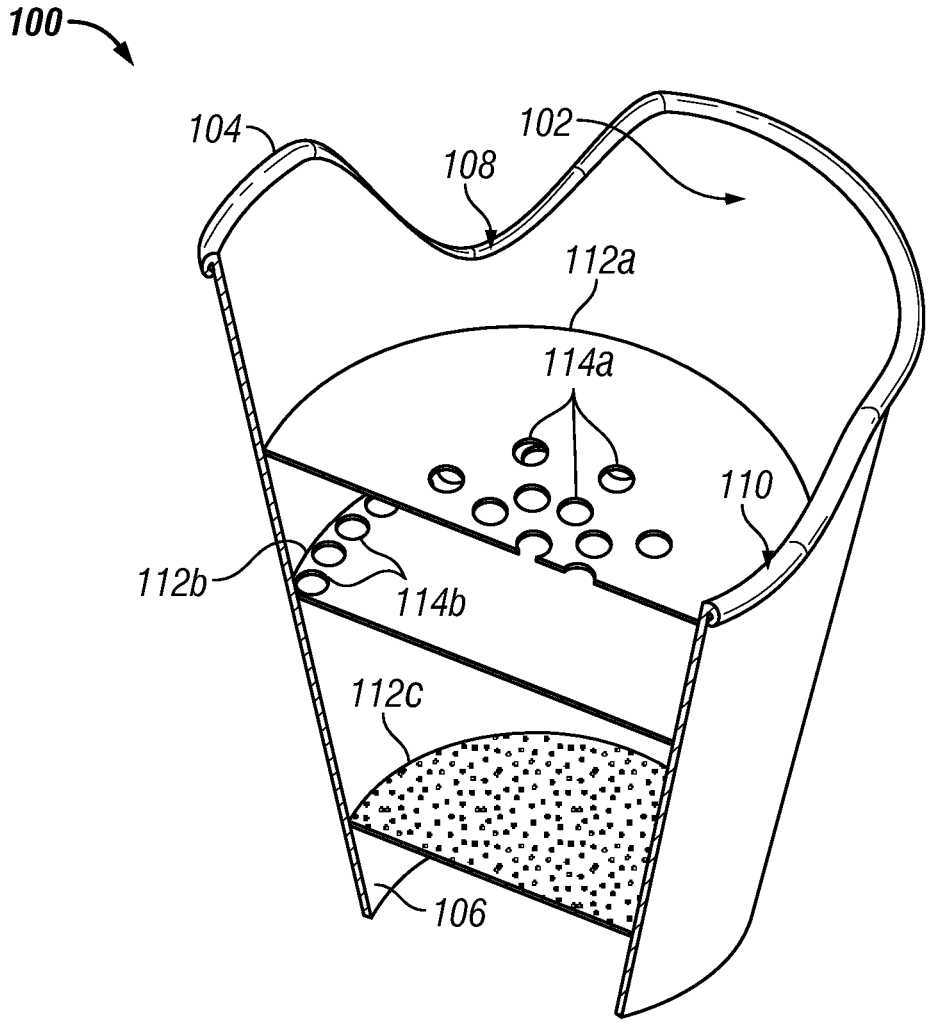
FIG. 2 illustrates a cross-sectional view of the device of FIG. 1A.

FIG. 2 illustrates a cross-sectional view of the device 100 of FIG. 1A. In some embodiments, the device 100 includes a plurality of filters pre-attached within the device 100 at predetermined locations. In one embodiment, the device 100 in FIG. 2 includes three different filters each having a different function. A first filter 112*a* may be "high flow" filter having a plurality of apertures 114*a* of a first size and positioned proximal to the opening 102 and within the device 100. A second filter 112*b* may be a "slow flow" or "absorbent flow" filter having a plurality of apertures 114*b* of a second size and positioned approximately at the middle of and within the device 100. In some embodiments, the plurality of apertures 114*a* of the first size is greater than the plurality of apertures 114*b* of the second size. In some embodiments, the plurality of apertures 114*a* are symmetrically spaced relative to one another and the plurality of apertures 114*b* are symmetrically spaced relative to one another as well. A third filter 112*c* may be a "stop flow" filter having no apertures and positioned proximal or adjacent to the bottom 106 and within the device 100.

According to embodiments of the invention, the plurality of apertures 114*a* of the first filter 112*a* may have a diameter between five hundred (500) micrometers (μm) and fifteen hundred (1500) μm. The function of the first filter 112*a* is to trap large matter, such as sputum and mucus, when a person coughs or sneezes into the device 100. Hence the reference to "high flow." The plurality of apertures 114*b* of the second filter 112*b* may have a diameter between 250 μm and 750 μm. The function of the second filter 112*b* is to further absorb smaller particulate matter which was allowed to flow through the first filter 112*a* in the interest of minimizing initial pressure in order to allow continued from through the device 100. Hence the reference to "slow flow" or "absorbent flow." The third filter 112*c* has no or substantially no apertures. The function of the third filter is to trap any airborne viruses and bacteria from escaping the device 100. Hence the reference to "stop flow."

According to embodiments of the invention, each filter 112*a*, 112*b* and 112*c* may be embedded or infused with a microbicide such as an antibacterial or a viricide. Examples of suitable microbicides include, but are not limited to, benzalkonium chloride (BAC), cetyl trimethylammonium bromide (CTMB), cetylpyridinium chloride (CPC), benzethonium chloride (BZT) or any combination thereof. The microbicide may be incorporated into the filters 112*a*, 112*b* and 112*c* by methods known by those of ordinary skill in the art.

According to embodiments of the invention, the device 100 may vary in length from the uppermost point of the rim 104 to the bottom 106. In some embodiments, the length of the device 100 may be between about three (3) inches and about six (6) inches. In this respect, the device may accommodate a child or an adult. In one embodiment, the length of the device 100 is about five (5) inches. Accordingly, the first filter 112*a* may be approximately two (2) inches from the uppermost point of the rim 104; the second filter 112*b* may be approximately three (3) inches from the uppermost point of the rim 104; and the third filter 112*c* may be approximately four and one-half (4½) inches from the uppermost point of the rim 104. Each filter 112*a*, 112*b* and 112*c* may be pre-attached to an inner surface of the device 100 by an adhesive or any other suitable attaching substance.

Figure 3:
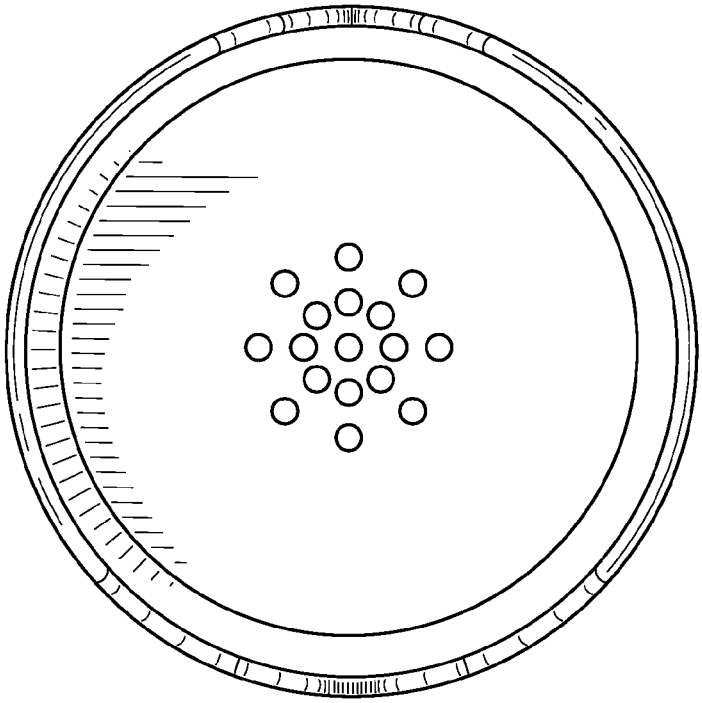
FIG. 3 illustrates a top view of the device of FIG. 1A.

FIG. 3 illustrates a top view of the device 100 of FIG. 1A. As shown, the first recess and second recesses 108, 110 are more clearly illustrated. The depth of each recess 108, 110 may be between one (1) inch and two (2) inches depending on the overall size of the device 100.

Figure 4:
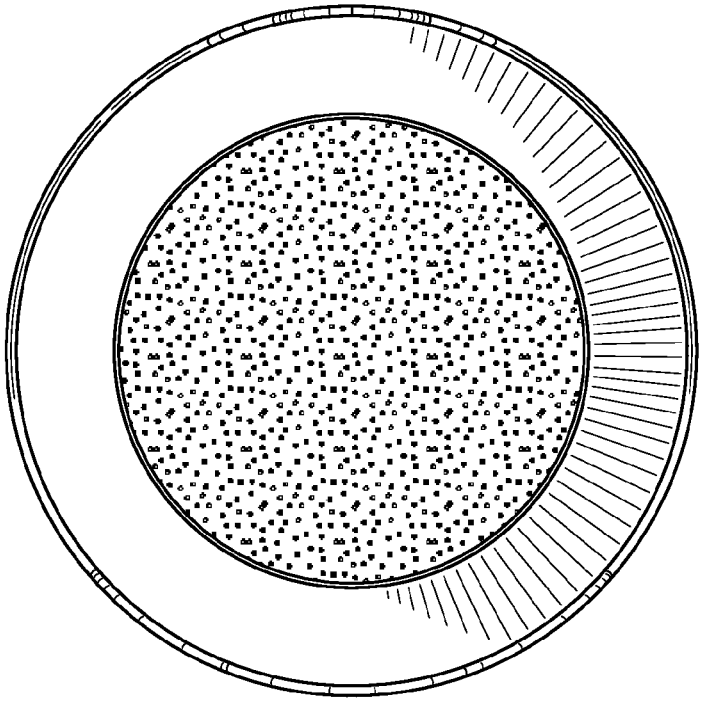
FIG. 4 illustrates a bottom view of the device of FIG. 1A.

FIG. 4 illustrates a bottom view of the device 100 of FIG. 1A.

Figure 5:
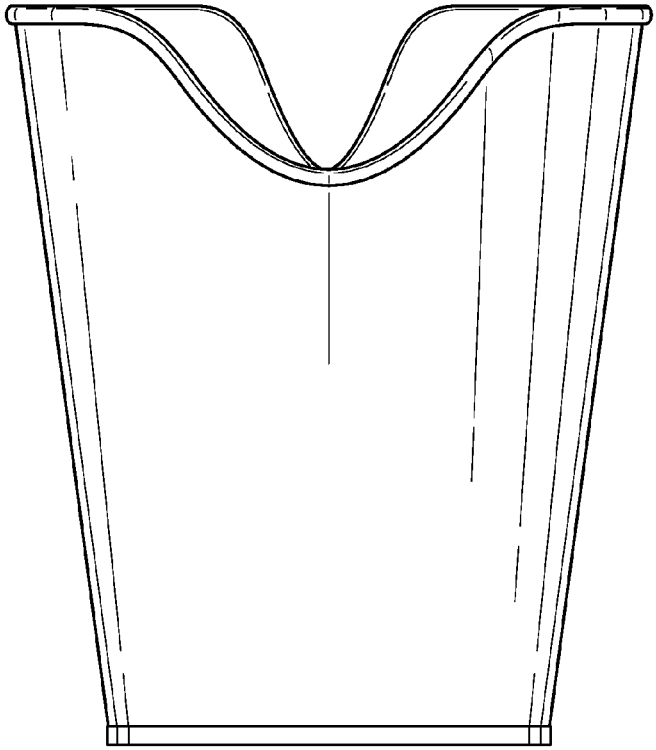
FIG. 5 illustrates a front view of the device of FIG. 1A.

FIG. 5 illustrates a front view of the device 100 of FIG. 1A.

Figure 6:
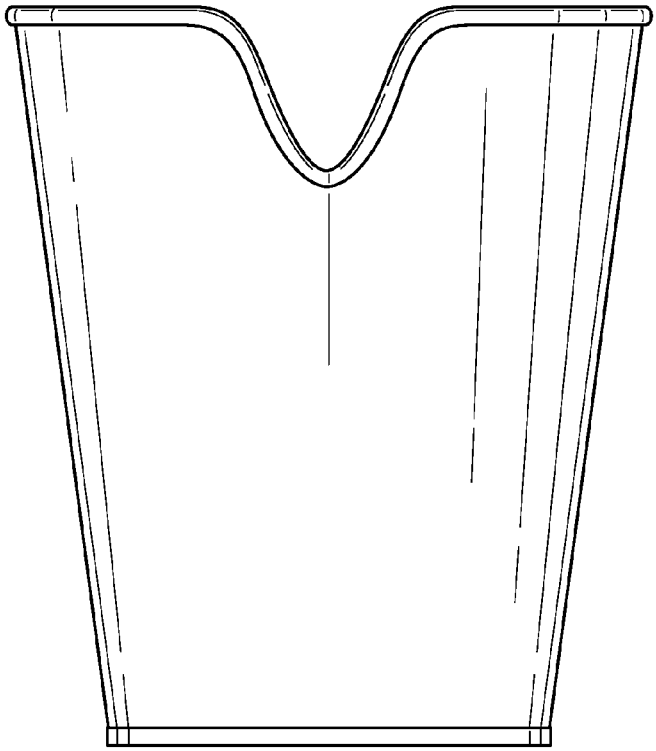
FIG. 6 illustrates a back view of the device of FIG. 1A.

FIG. 6 illustrates a back view of the device 100 of FIG. 1A.

In use, a person may use the device as described previously by placing the device next to the person's mouth and coughing into the device (see FIG. 1B). The nose bridge and chin bridge allows for a comfortable fit about the person's mouth and substantially or completely eliminates infectious material from escaping therefrom. Alternatively, the device may be placed on the person's nose.

Advantageously, a hygienic device according to embodiments of the invention can be used in any public or private location to control the spread of airborne viruses and bacteria emanating from coughing or sneezing. The device is disposable and eliminates contact of a person's hand or arm when the person coughs or sneezes thereby preventing transfer of infectious material to door handles, rails, desks or any other surface with which multiple persons may come into contact (thereby likely spreading the infectious material to others). Moreover, the device may be embedded with a microbicide which kills bacteria and/or viruses. Thus, if the device is accidently dropped, e.g., on a desktop, the chance of transfer of infectious material is substantially reduced (relative to, e.g., a tissue).

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A hygienic device to control the spread of airborne viruses and bacteria emanating from coughing or sneezing, comprising:

a cup having a cylindrical sidewall, the cylindrical sidewall having a rim at a first end and a bottom edge at a second opposing end where the cylindrical sidewall has a continuously downwardly decreasing diameter from the rim to the bottom edge;

a first filter suspended and attached within an interior of the cup near the rim of the cup, the first filter having a plurality of apertures of a first size;

a second filter suspended and attached within the interior of the cup near a middle of the cup, the second filter having a plurality of apertures of a second size, the second filter separated from the first filter by a first gap; and a third filter suspended and attached within the interior of the cup near the bottom edge of the cup, the third filter separated from the second filter by a second gap.

2. The hygienic device of claim 1, further comprising:

a first recess in the rim of the cup, the first recess to accommodate a nose of a person; and a second recess in the rim of the cup, the second recess positioned 180 degrees relative to the first recess, the second recess to accommodate a chin of the person.

3. The hygienic device of claim 1 wherein a diameter of each of the plurality of apertures of the first size is greater than a diameter of each of the plurality of apertures of the second size.

4. The hygienic device of claim 3 wherein each of the plurality of apertures of the first size are symmetrically spaced throughout the first filter and each of the plurality of apertures of the second size are symmetrically spaced throughout the second filter.

5. The hygienic device of claim 4 wherein the plurality of apertures of the first size are between 500 micrometers and 1500 micrometers and the plurality of apertures of the second size are between 250 micrometers and 750 micrometers.

6. The hygienic device of claim 1 wherein each of the first, second and third filters are embedded with a microbicide.

7. The hygienic device of claim 6 wherein the microbicide is an antibacterial, viricide or a combination thereof.

8. The hygienic device of claim 7 wherein the microbicide is an antibacterial selected from the group consisting of benzalkonium chloride (BAC), cetyl trimethylammonium bromide (CTMB), cetylpyridinium chloride (CPC), benzethonium chloride (BZT) or any combination thereof.

9. The hygienic device of claim 1 wherein each of the first, second and third filters are comprised of an absorbent material.

10. A hygienic device to control the spread of airborne viruses and bacteria emanating from coughing or sneezing, comprising:

a containment device, the containment device having a first end defining a bottom edge and an opposing second end defining a rim, the containment device having a cylindrical sidewall, the cylindrical sidewall having a continuously downwardly decreasing diameter from the rim to the bottom edge;

a first filter suspended and attached within an interior of the cylindrical sidewall of the device near the second end, the first filter having a plurality of apertures of a first size;

a second filter suspended and attached within the interior of the cylindrical sidewall of the device near a middle of the device, the second filter having a plurality of apertures of a second size and separated from the first filter by a first gap; and a third filter suspended and attached within the interior of the cylindrical sidewall of the device near the first end, the third filter separated from the second filter by a second gap.

11. The hygienic device of claim 10, further comprising:

a first recess in the rim of the device, the first recess to accommodate a nose of a person; and a second recess in the rim of the device, the second recess positioned 180 degrees relative to the first recess, the second recess to accommodate a chin of the person.

12. The hygienic device of claim 10 wherein a diameter of each of the plurality of apertures of the first size is greater than a diameter of each of the plurality of apertures of the second size.

13. The hygienic device of claim 12 wherein each of the plurality of apertures of the first size are symmetrically spaced throughout the first filter and each of the plurality of apertures of the second size are symmetrically spaced throughout the second filter.

14. The hygienic device of claim 13 wherein the plurality of apertures of the first size are between 500 micrometers and 1500 micrometers and the plurality of apertures of the second size are between 250 micrometers and 750 micrometers.

15. The hygienic device of claim 10 wherein each of the first, second and third filters are embedded with a microbicide.

16. The hygienic device of claim 15 wherein the microbicide is an antibacterial, viricide or a combination thereof.

17. The hygienic device of claim 1 wherein the plurality of apertures in the first filter are located in a center area of the first filter.

18. The hygienic device of claim 1 wherein the plurality of apertures in the second filter are located around an outer edge of the second filter.

19. A hygienic device to control the spread of airborne viruses and bacteria emanating from coughing or sneezing, comprising:

a containment device, the containment device having a first end defining a bottom edge and an opposing second end defining a rim, the containment device having a cylindrical sidewall, the cylindrical sidewall having a continuously downwardly decreasing diameter from the rim to the bottom edge;

a first filter suspended and attached within an interior of the cylindrical sidewall of the device near the second end, the first filter having a plurality of apertures of a first size, the plurality of apertures in the first filter located in a center area of the first filter;

a second filter, separated from the first filter by a first gap, suspended and attached within the interior of the cylindrical sidewall of the device near a middle of the device, the second filter having a plurality of apertures of a second size, the plurality of apertures in the second filter located around an outer edge of the second filter; and a third filter suspended and attached within the interior of the cylindrical sidewall of the device near the first end, the third filter separated from the second filter by a second gap;

wherein the second filter has a diameter smaller than a diameter of the first filter and larger than a diameter of the third filter.

* * * * *